United States Patent [19]

Sweeny

[11] Patent Number: 5,071,100

[45] Date of Patent: Dec. 10, 1991

[54] MULTI-PURPOSE CANISTER WALL BRACKET

[75] Inventor: Henry D. Sweeny, Kitchener, Canada

[73] Assignee: Swenco Limited, Ontario, Canada

[21] Appl. No.: 608,736

[22] Filed: Nov. 5, 1990

Related U.S. Application Data

[62] Division of Ser. No. 401,112, Aug. 31, 1989, Pat. No. 4,997,157.

[30] Foreign Application Priority Data

Feb. 24, 1989 [CA] Canada ..... 529053

[51] Int. Cl.[5] ..... A47K 1/08

[52] U.S. Cl. ..... 248/313; 248/310; 248/311.2

[58] Field of Search ..... 248/313, 311.2, 310, 248/311.3, 317, 317.1; 211/73, 88

[56] References Cited

U.S. PATENT DOCUMENTS

| | | | |
|---|---|---|---|
| 2,081,216 | 5/1937 | Bosserman | 211/75 X |
| 2,277,738 | 3/1942 | Wilkinson . | |
| 2,663,531 | 12/1953 | Rubano . | |
| 2,877,976 | 3/1959 | Massari . | |
| 2,936,992 | 5/1960 | Browning . | |
| 3,069,538 | 12/1962 | Hobson . | |
| 3,370,369 | 2/1968 | Look . | |
| 3,842,688 | 5/1974 | Baginski . | |
| 3,994,051 | 3/1976 | Serretti, Jr. . | |
| 4,137,606 | 6/1979 | Wood . | |
| 4,304,383 | 10/1981 | Huston . | |
| 4,305,512 | 12/1981 | Mackenzie | 211/75 |
| 4,379,541 | 4/1983 | Harkness . | |
| 4,749,112 | 8/1988 | Harper . | |
| 4,767,092 | 10/1988 | Weatherly . | |

FOREIGN PATENT DOCUMENTS

| | | | |
|---|---|---|---|
| 214297 | 3/1961 | Austria . | |
| 869406 | 7/1971 | Canada . | |
| 3207858 | 9/1983 | Fed. Rep. of Germany . | |
| 718568 | of 1931 | France . | |
| 24468 | 4/1908 | Sweden | 211/75 |

*Primary Examiner*—Alvin C. Chin-Shue

*Attorney, Agent, or Firm*—Jones, Tullar & Cooper

[57] ABSTRACT

A bracket assembly for supporting a cylindrical canister, such as a fire extinguisher, includes a base unit having a longitudinally extending, transversely concave, front surface for cradling the canister therein and a separate flexible strap member which can be wrapped around the canister to hold it against the base unit. The base unit includes opposing cutouts in the sides thereof into which a central section of the strap can be pressed before mounting on the wall so as to interlock the strap member with the base unit. One end of the strap has a hook member thereon for engaging the other end of the strap by way of a selected one of a plurality of mating apertures therethrough. The back surface of the base unit is transversely concave and the strap member has rearwardly projecting wedge members which engage the wall during mounting and preset the strap to conform generally to the shape of the back surface. The bracket assembly is inexpensive to produce, provides support for a canister, is universal in nature in that it will accommodate different canister sizes and configurations, and it is capable of quick release if necessary.

7 Claims, 4 Drawing Sheets

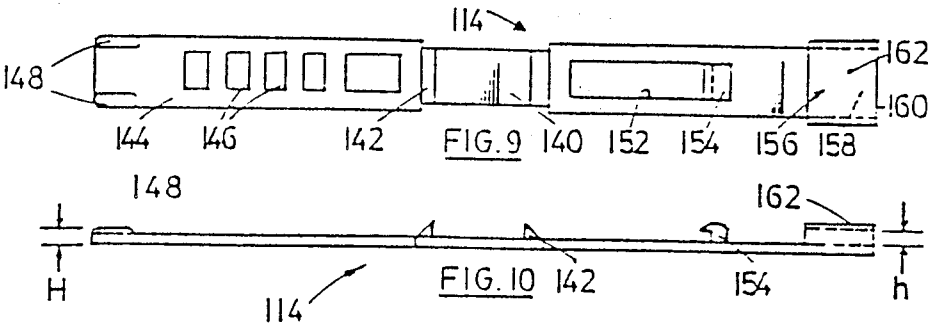
FIG. 9
FIG. 10
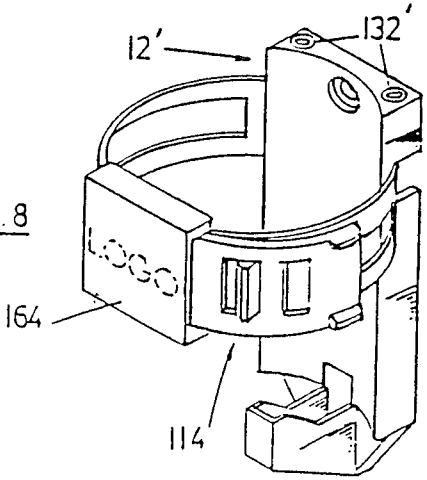
FIG. 8
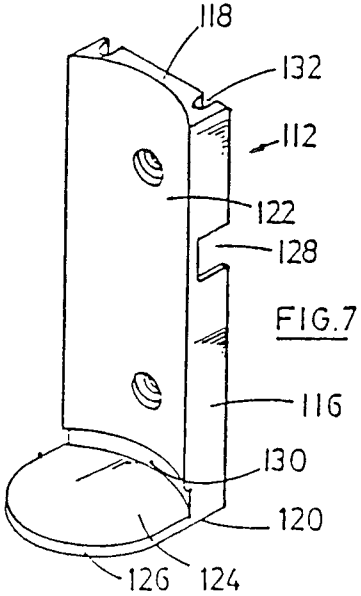
FIG. 7

MULTI-PURPOSE CANISTER WALL BRACKET

This is a divisional of copending application(s) Ser. No. 07/401,112 filed on Aug. 31, 1989, now U.S. Pat. No. 4,997,157, issued Mar. 5, 1991.

The present invention relates to brackets in general and in particular to wall-mountable brackets capable of holding cylindrical objects such as aerosol canisters, including fire extinguishers.

BACKGROUND OF THE INVENTION

There are several cylindrical objects in general use which, desirably, can be mounted on a wall for convenient or immediate access. One such object is the common fire extinguisher. Fire extinguishers are available in many sizes and in different ratings. Many fire extinguishers are purchased with accompanying wall brackets, intended to hold the extinguisher at a location selected by the user to be most advantageous in the event of a fire. Prior art brackets, however, have not enjoyed extensive engineering to optimize effectiveness and cost and there has not yet been available a universal bracket which can be used with almost any size of fire extinguisher from any manufacturer. Most prior art brackets have been especially designed to work only with specific designs of fire extinguisher canisters and cannot be used with other canister designs. Fabricated metal brackets tend to be quite expensive and prior art plastic brackets have not been of adequate strength to carry heavy fire extinguishers.

One such style of prior art bracket is in the shape of an outwardly opening vertically extending rectangular box with a pair of concave cylinder-receiving surfaces or saddles extending across the open box between the sides thereof. A suspension mechanism, in the form of an outwardly opening retaining hook is at the top of the box for engagement with the neck of a fire extinguisher. A flexible strap, having an asymmetrical necked-in area at the centre thereof, is connected to the box thereacross at the back thereof. The box has a curved surface at the back against which the strap will lie in use, and at the free ends thereof the strap is provided with an overcentre latch adapted for quick release. The bracket is adapted for utilization with but a single diameter of canister since otherwise the strap would not operate to hold a canister in place. With a larger diameter canister the strap would not stretch therearound, and with a smaller diameter canister the strap would be too loose and there would be a danger of the canister falling from its suspension hook. Furthermore such brackets are not aesthetically pleasing and they are not cost-effective to manufacture.

SUMMARY OF THE INVENTION

The present invention overcomes the problems of the prior art by providing a moulded plastic bracket base which is lightweight, yet strong, and has a transversely concave elongated front surface adapted to cradle the body of a cylindrical object, such as a fire extinguisher, to be carried thereby. Appropriate means, such as screws, are provided to mount the base unit to a wall. The base unit is open to the back and the inner wall of the unit appears as a convex surface, parallel to the concave outer surface. Matching cutouts are provided in the longitudinal side walls of the unit to accept therein an elongated flexible strap, which strap has a central portion adapted to interlock with the cutouts such that one end portion of the strap will extend laterally outwardly from one side of the base unit and the other end portion of the strap will extend outwardly from the other side of the base unit. The strap end portions are provided with first and second locking means for interlocking engagement when the end portions are wrapped around a cylindrical object. The interlocking means are designed so that very little effort is required to release the object, particularly important with fire extinguishers.

If desired, especially for heavy objects, the base unit can be provided with an outwardly projecting member which accepts the bottom of a cylindrical object and thereby supports the weight of the object to prevent it falling from the bracket. Also, an upper member can be provided for engagement with, for example, the upper valve casing of a fire extinguisher so as to even more securely hold the extinguisher in place. If desired, such upper member could be designed so that it could telescope into or out of the base unit and thus make the bracket more universal in its utility with different sizes an models of fire extinguishers. A simple ratchet mechanism could be used to keep the movable upper portion at its desired position relative to the base unit or the upper portion could be provided with its own means for securing it to a wall.

Should there be concern that a single strap might not be adequate to hold a large cylindrical object the base unit could be provided with longitudinally spaced pairs of cutouts, each pair adapted to receive a strap therein. If more than two straps are used, however, the speed with which a fire extinguisher could be released from the bracket during an emergency might be less than desirable.

The strap of this invention may be provided with rearwardly extending projections in the area contained within the base unit for engagement with the wall when the base unit is attached to the wall. The projections would tend to push the strap towards the inner convex wall of the base unit, causing the strap end portions to angle outwardly from the wall and thereby making it easier to wrap them around a cylindrical object.

Other variations on the concept of the present invention involve the utilization of a flexible strap that has a tunnel on one portion thereof through with the other portion can pass so that the strap can be loosened to permit removal of the canister without the strap portions actually separating; the utilization of a solid circular ring instead of a flexible strap, especially for canisters that will be removed regularly from the bracket; and the utilization of a plurality of brackets joined together side-by-side to accommodate a plurality of canisters.

BRIEF DESCRIPTION OF THE DRAWINGS

FIG. 7 shows a perspective view of another form of base unit;

FIG. 8 shows a perspective view of another embodiment of the present invention, utilizing a different strap;

FIG. 9 shows a plan view of the strap utilized in the embodiment of FIG. 8;

FIG. 10 shows the strap of FIG. 9 in elevation;

DESCRIPTION OF THE PREFERRED EMBODIMENT

Figure 1:
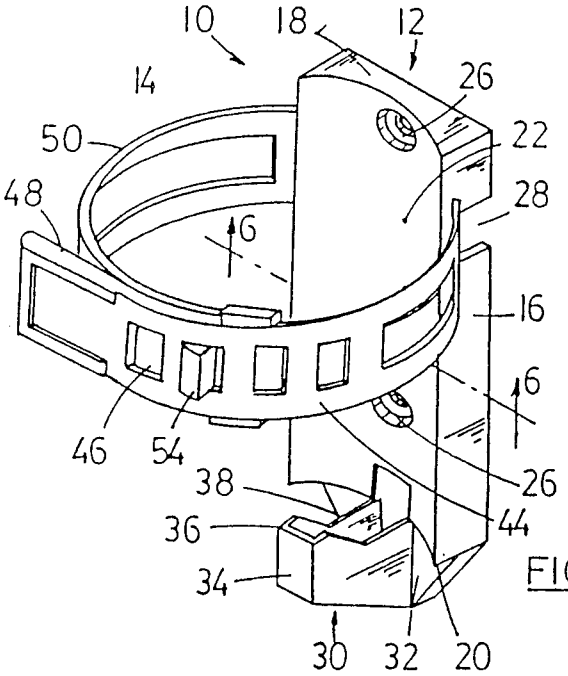
FIG. 1 shows a perspective view of the bracket of this invention as it might be mounted on a wall.

The preferred embodiment of the canister wall-bracket 10 of this invention is shown in FIG. 1. The bracket includes two main components, namely a base unit 12 and a flexible strap 14, the latter being seen in more detail in FIGS. 2 and 3.

The base unit 12 is elongated and generally rectangular in elevation, having flat side walls 16,16 and flat upper and lower end walls 18,20. The front surface 22 of the base unit is transversely concave to receive therealong the cylindrical outer wall of a canister, such as a fire extinguisher. Since it is contemplated that the bracket of this invention will be universal in nature the radius of curvature of the surface 22 should be selected to accommodate the largest diameter of canister expected to be carried thereby. If different sizes of base units are to be manufactured then the radius of curvature of surface 22 can be more closely matched to the size or sizes of canisters to be carried thereby.

Figure 6:
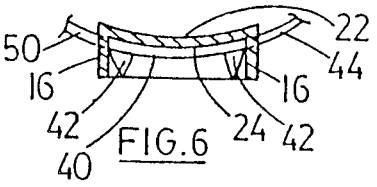
FIG. 6 is a cross-section taken on the line 6—6 of FIG. 1.

As seen in FIG. 6 the base unit is hollow, opening to the back. The inner wall 24 of the unit presents a convex face to the back of the unit, generally parallel to the outer surface 22.

The base unit 10 may be integrally molded from a strong plastic such as polypropylene using standard molding techniques. During such molding recessed circular screw-receiving wells 26 many be provided in the front surface 22 to facilitate mounting the bracket to a wall. Screws (not shown) may be received in the wells 26 and driven into the wall, or anchors therein, to secure the base unit 12 to the wall. After mounting, the screw heads will be below the front surface 22 and will not interfere with a canister resting against that surface.

During molding the side walls 16,16 will each be provided with a rectangular cutout 28, which cutout extends inwardly to adjacent the inner wall 24. In the embodiment of FIG. 1 the cutouts 28,28 are close to the upper end wall 18 of the base unit. For a secure mounting of the base unit to a wall the cutouts 28 should be located between the screw-receiving wells 26.

The embodiment of FIG. 1 illustrates a bottom support member 30 which projects outwardly and will support the bottom wall of a canister carried by the bracket. The illustrated member 30 is integrally molded with the base unit and includes a thin plate section 32 which will abut the wall to which the base unit 12 is mounted and a generally U-shaped foot 34 projecting outwardly from the plate 32. The foot 34 has an upwardly projecting portion 36 which is adapted to enter into the upwardly cupped bottom of a pressurized canister to engage the bottom wall thereof and thereby support the canister. Clearance is provided by the dropped or cut-away portion 38 of the foot 34.

Figure 2:
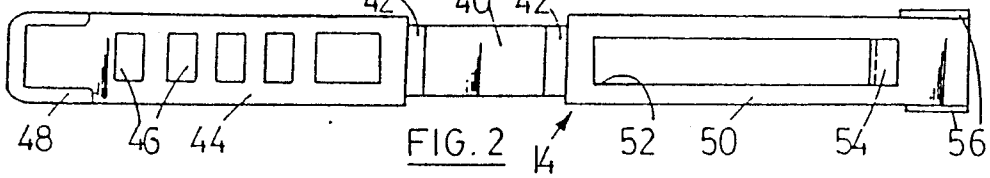
FIG. 2 shows a plan view of a strap as used with this invention.
Figure 3:
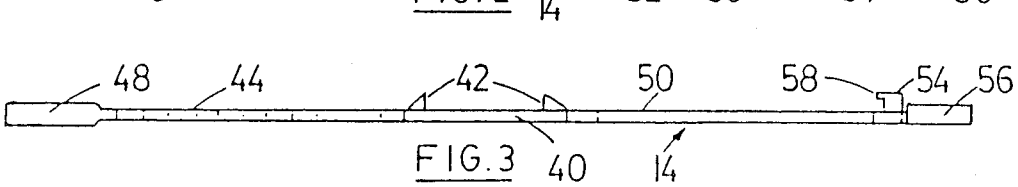
FIG. 3 shows the strap of FIG. 2 in elevation.

Turning now to FIGS. 2 and 3 the strap 14 of this invention will be described. The strap 14 is preferably integrally molded from a plastics material to achieve a flexible yet durable member, the preferred material being EVA (ethylvinylacetate). The strap 14 is thin and narrow and is provided centrally with a narrower section 40 that has a length slightly greater than the width of base unit 12. The width of the central section 40 is the same as the width of cutout 28 so that the central section 40 can be received in the cutouts 28 and thereby lock the strap 14 to the base unit 12. Projecting upwardly from the central section 40 in FIG. 3 is a pair of spaced apart transverse wedge members 42, the purpose of which will become apparent hereinafter.

One end portion 44 of the strap has a plurality of adjacent rectangular openings 46 extending therethrough, the number of openings 46 depending on the length of the strap and the degree of adjustability required. The free end of strap portion 44 has a thicker, generally U-shaped, enlargement 48 thereon to protect the strap and to provide a section easily gripped by someone wanting to release a canister from the bracket.

The other end portion 50 of the strap 14 has a long rectangular opening 52 therethrough and an inverted L-shaped hook member 54 projecting in the same direction as the wedges 42. At the free end thereof the portion 50 includes a pair of integral guide strips 56 of a thickness greater than that of the strap itself.

Reference is now made to FIGS. 1 and 6 to show the bracket in its "as used" condition. FIG. 1, for example, shows the strap 14 engaged with the base unit 12. The central section 40 is locked to the base unit via the inter-engagement at the cutouts 28. The strap end portions are flexed towards each other as if wrapped around a cylindrical canister and the hook member 54 is pushed through one of the openings 46 so that the edge of the opening is engaged with the hook member 54 under the upper flange 58 thereof. Such engagement prevents the one end portion 44 from disengaging inadvertently from the hook member 54, it being understood that the natural tendency of the strap end portions is to unwrap from the canister and this tendency keeps the hook member 54 in engagement with the end portion 44 through the appropriate opening 46. Engagement is enhanced by the guide straps 56 which engage the side edges of the strap end portion 44 and prevent relative twisting between the end portions 44 and 50.

When mounting the bracket 10 to a wall the strap 14 is first of all assembled to the base unit via the cutouts 28. Before mounting to a wall the strap end portions 44,50 extend straight out from the sides 16,16 of the base unit. However, when the screws are tightened to secure the base unit 12 to the wall the wedges 42 will first contact the wall and, due to their shape, they will tend to spread apart thereby causing the strap end portions 44,50 to angle outwardly from the wall and thus causing the central strap section 40 to conform generally to the convex inner wall 24 of the base unit as seen in FIG. 6 This makes it easier to grasp the free ends of the strap to wrap the end portions 44,50 about the canister to be supported thereby.

Figure 4:
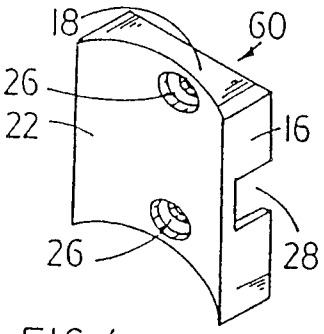
FIG. 4 shows a perspective view of a simplified base unit for the present invention.

FIG. 4 illustrates a basic or simplified base unit 60 that is usable with a strap 14 as previously described. The base unit 60 is the sam as base unit 12 except that it does not have a support member 30 and it may be shorter overall. Thus the same reference numbers have been shown in FIG. 4 for the base unit 60. Such a base unit could be used with a lightweight canister that does not require additional support or it could be used to support canisters in a generally horizontal attitude rather than in a vertical attitude.

Figure 5:
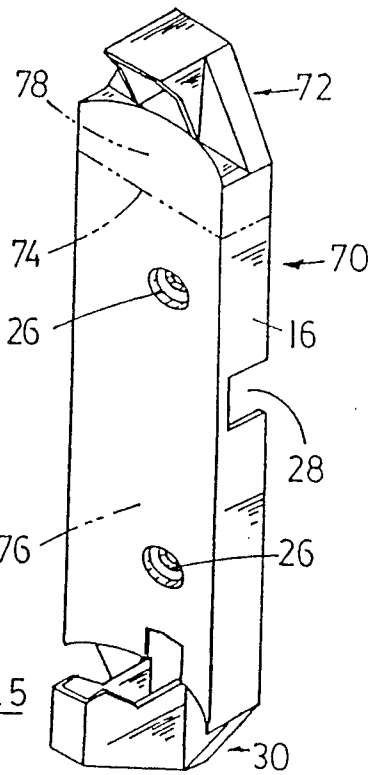
FIG. 5 shows a perspective view of a base unit for another embodiment of the present invention.

FIG. 5 shows another base unit 70 which is essentially the same as base unit 12 except that it has an upper support section 72 integrally molded therewith, which section is designed to mate with the upper end of a canister to be held thereby. In the illustrated embodiment the section 72 is shown as being not unlike the section 30 in general configuration but the actual configuration selected will depend on the design of the canister to be supported.

The chain dotted line 74 in FIG. 5 is intended to illustrate that the base unit 70 could be made in two parts, 76,78 with the part 78 including an internal downwardly projecting female extension (not shown) for mating with the lower part 76 such that the part 78 can telescope relative to the part 76 and thereby accommodate canisters of different lengths. The telescoping function could involve a simple ratchet mechanism so that the part 78 would be movable only with some effort against the ratchet mechanism or alteratively the part 78 could have its own recessed well for receiving a screw such that the part 78 itself could be independently secured to a wall.

FIGS. 7 to 15 illustrate variations on the concept according to FIGS. 1 to 6. Although the invention has been described with particular reference to fire extinguishers it is clear that the bracket of this invention could be used to hold any type of cylindrical object. For example, but not by way of limitation, the brackets of this invention could be used to hold aerosol, spray-type or any other containers of solvent, cleaner, paint, lubricant, water, vegetable oil, etcetera in the kitchen, pantry, bathroom, garage, greenhouse, garden shed, workshop, recreation vehicle, boat, truck, automobile or factory. Different brackets can be used to hold different types of containers.

Figure 13:
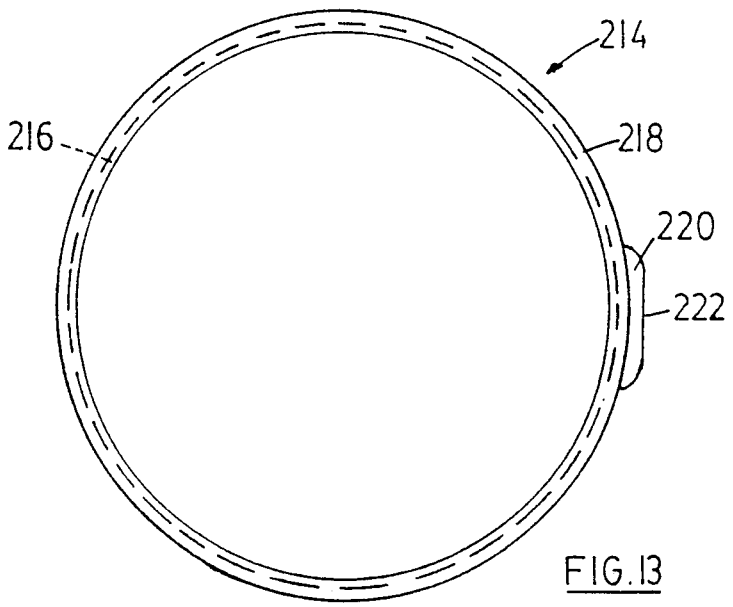
FIGS. 13 and 14 show top and bottom views respectively of a ring-like retainer useful with the brackets shown in FIGS. 1, 4, 5, 7, 8 and 12.
Figure 14:
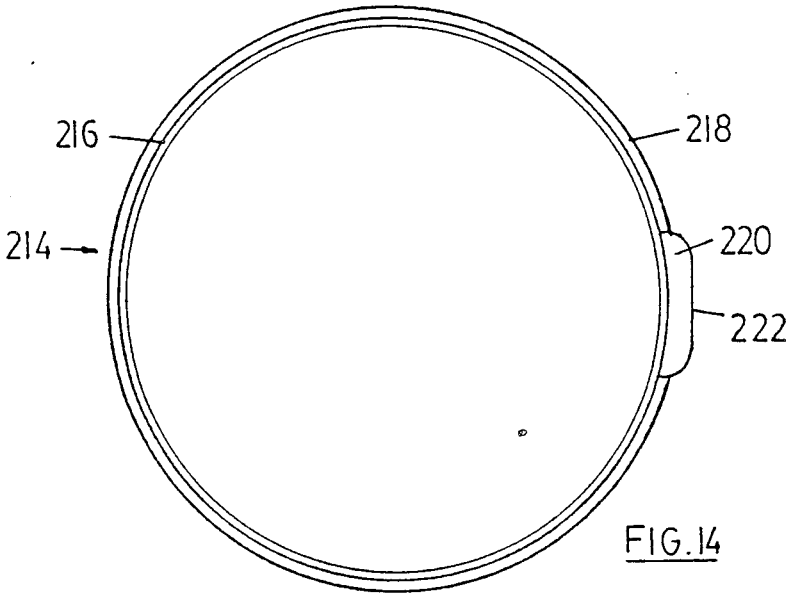
Figure 15:
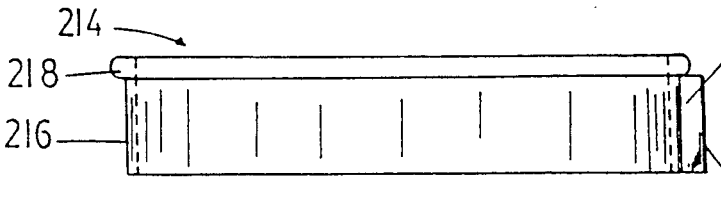
FIG. 15 shows a side view of the retainer of FIGS. 13 and 14.

Turning now to FIG. 7 there is shown a base unit 112 having side walls 116,116, a flat upper end wall 118 and a concave front surface 122. The flat bottom end wall 120 extends forwardly as a thin flat foot or support 124 having a rounded edge 126. Adjacent the curved front surface 122 at the bottom thereof there is a recessed notch 130. Also, in the upper end wall 118 there is a pair of U-shaped openings 132 for reception therein of a small diameter tube such as might be used as a nozzle extension for an aerosol can of lubricant (e.g.. WD-40®). A canister will sit on the foot 124 and its cylindrical body will be cradled against the concave surface 122. The rounded rim at the bottom of the canister will be received in the notch 130 to avoid any misalignment of the canister in the bracket. To hold the canister in place a strap, such as the flexible straps shown in FIGS. 2, 3, 9 and 10, or a ring such as that shown in FIGS. 13 to 15, is engageable with the cutouts 128 provided in the sides 116,116.

FIG. 8 shows another base unit 12' which is the same as the base unit 12 shown in FIG. 1 except that it includes circular openings 132' having the same purpose as the U-shaped openings 132 shown in FIG. 7. The bracket assembly of FIG. 8 is also shown using the modified strap 114 of FIGS. 9 and 10.

The strap 114 of FIGS. 9 and 10 is very similar to the strap 14 of FIGS. 2 and 3 with the elements or features 140, 142, 144, 146, 150, 152, and 154 being essentially identical or at least equivalent to the elements or features 40, 42, 44, 46, 50, 52 and 54 of the strap 14. In the strap 114 the free end 144 has a pair of short, narrow, transversely rounded protrusions thereon 148 along each edge thereof. The other free end has a rectangular enclosed tunnel portion 156 moulded thereon, the tunnel portion including a through tunnel 158 of a height "h" sightly less than the combined thickness of the strap 114 and the height thereabove of the protrusions 148, i.e. dimension H.

Since the material of the strap 114 is flexible the 20 tunnel portion 156 will flex sufficiently to permit the end with protrusions 148 to pass through the tunnel 158. Then the strap can be locked around a canister with the hook member 154 engaging the edge of one of the openings 146 as shown in FIG. 8. To release the canister one merely lifts the free end 144 to disengage the hook member 154, the free end 144 of strap 114 sliding backwards in tunnel 158 as the canister is removed. However, the protrusions 148 will come up against the outer end 160 of the tunnel portion 156 and prevent complete separation of the free ends of the strap. This will make it easier to reset the strap about the canister after use as the end with protrusions 148 thereon is already held by tunnel portion 156 and it can be grasped and pulled through tunnel 158 to effect re-engagement of the hook member 15 in the relevant opening 146.

As can be readily seen in FIGS. 8 and 9 the front face 62 of the tunnel portion 156 presents a fairly large expanse in which a logo, instructions or advertising material can be hot-stamped or moulded, or on which an appropriate label can be secured.

Figure 11:
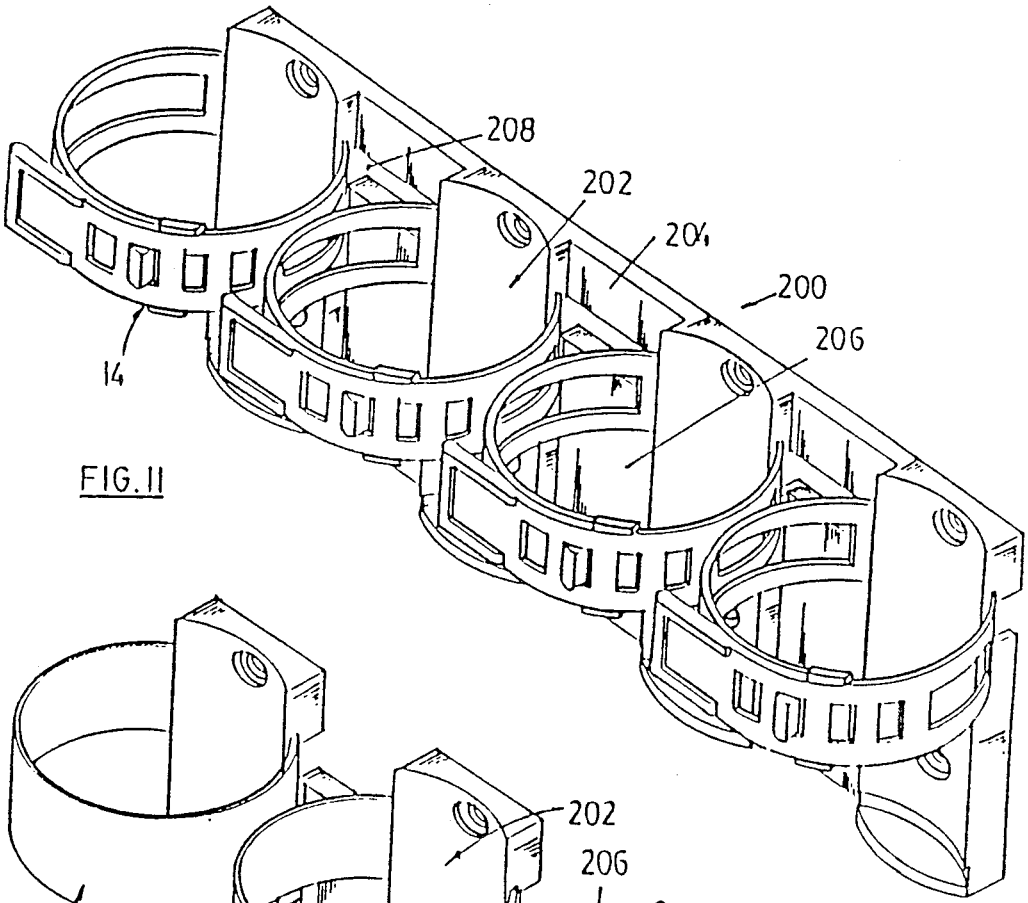
FIG. 11 shows a perspective view of a multi-unit bracket assembly of this invention.

FIG. 11 illustrates a multiple bracket assembly 200 comprising a plurality of individual base units 202 joined together by upper and lower webs 204,206. Each base unit 202 can be similar to any of the previously described base units 12, 60, 70, 112 or 12' or any variation thereof. There is a rectangular gap 208 between the upper and lower webs 204,206 to permit the insertion of a flexible strap, such as illustrated strap 14. Of course, strap 114 could also be used in the multiple bracket assembly.

A multiple bracket assembly could find great utility in, for example, a laundry room wherein several canisters of different products are used. One of the brackets of the multiple assembly might carry a fire extinguisher, while another might carry a can of powder cleanser, yet another carrying a can of spray starch and yet another carrying a bottle of bleach. By using flexible adjustable straps one is not limited to a bracket assembly that can carry only a single diameter of canister.

Figure 12:
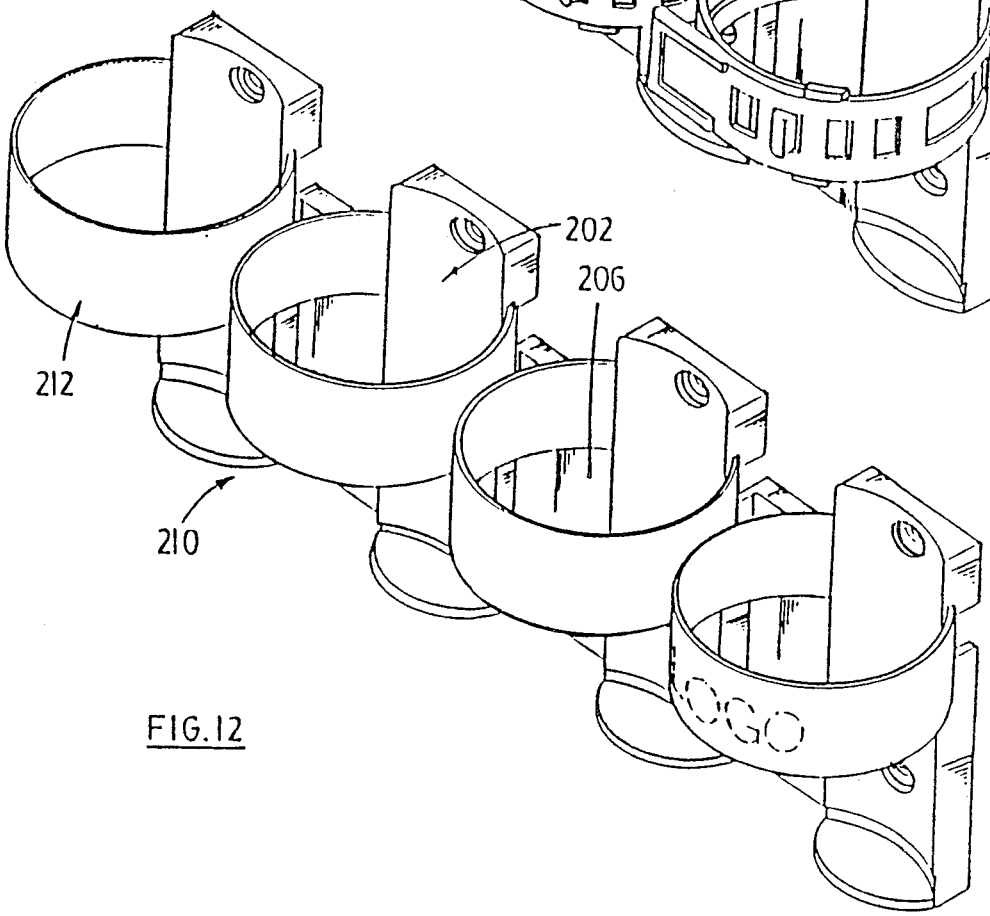
FIG. 12 shows a perspective View of another multi-unit bracket assembly of this invention.

If a multiple bracket assembly is required for a plurality of products contained within canisters of the same diameter then one could use the assembly 210 of FIG. 12. The base units 202 are the same as in FIG. 11 but the units are connected together only by lower webs 206. The absence of upper webs permits the flexible, adjustable, straps to be replaced by solid rings 212 which define an opening therethrough of a fixed diameter, preferably slightly larger than the canister to be held thereby. Such rings 212 engage in the cutouts of each base unit just as do the flexible straps of the previous embodiments. When the bracket assembly 210 is attached to a wall the rings 212 will be held solidly in place by being clamped between the wall and the curved surface, such as surface 24, at the back.

FIGS. 13, 14 and 15 illustrate a solid ring type of retainer 214 that can be used in the multiple assembly 210 of FIG. 12 or with any of the previously described base units for that matter. This ring 214 has a cylindrical side wall 216 with a strengthening cylindrical rib 218 projecting radially outwardly at the top. A raised wedge portion 220 on the outer surface of wall 216 has a generally flat outer surface 222 for abutment against a wall when the ring 214 is in place in the cutouts of a base unit. Thus the raised portion 220 serves essentially the same purpose as the wedges 42,142 provided on the flexible straps previously described.

As with the tunnel portion 156 the rings 212,214 can have appropriate identification, advertising or instructional material hot-stamped, moulded or adhered in or to the outer surface thereof.

The bracket of the present invention is simple and economical to produce and it is sufficiently attractive that it will not be out of place in high traffic areas such as a kitchen. It is readily adjusted to suit canisters of different sizes and may be considered as a universal bracket for cylindrical articles. While the foregoing has described the desirable features of the invention in terms of preferred embodiments it is clear that a skilled person in the art could effect changes to the design without departing from the spirit of the invention and hence the protection to be afforded the invention is to be determined from the claims appended hereto.

The embodiments of the invention in which an exclusive property or privilege is claimed are defined as follows:

1. A bracket assembly for supporting a plurality of cylindrical objects thereon comprising: a plurality of rearwardly, laterally attached, opening base units each including a longitudinally extending transversely concave front surface for cradling an object therein, a transversely convex rear surface, longitudinal side wall members extending rearwardly from said front surface, and a cutout in each of said side wall members; a flexible strap member for each of said base units, each strap member including a central locking section of reduced width relative to the width of the remainder of the strap member engageable with said cutouts, a plurality of first locking means on one end portion of said strap member, and second locking means on the other end portion of said strap member, engageable with a selected one of said first locking means; and means for securing said assembly to a wall or the like; whereby with the central locking section of each strap member engaging the cutouts of an associated base unit said assembly may be mounted to a wall or the like with the end portions of the respective strap members extending away from the base unit associated therewith, a cylindrical object may be placed against the front surface of a base unit, and the strap end portions associated therewith may be wrapped around the object with the second locking means thereof moved into locking engagement with a selected one of said first locking means to secure the object against the base unit front surface.

2. The assembly a claim 1 wherein each base unit is spaced laterally from an adjacent base unit and is joined thereto by at least one laterally extending web member integral with facing side wall members of the adjacent base units.

3. A bracket assembly for supporting a plurality of cylindrical objects thereon comprising: a plurality of rearwardly laterally attached, open base units each including a longitudinally extending transversely concave front surface for cradling an object therein, a transversely convex rear surface, longitudinal side wall members extending rearwardly from said front surface, a cutout in each of said side wall members and a support member projecting forwardly from a lower portion thereof; a substantially inflexible annular retainer ring for each of said base units, each ring being adapted for retained engagement with the cutouts of an associated base unit and to project forwardly of the base unit front surface; and means for securing said assembly to a wall or the like; whereby with each retainer ring engaging the cutouts of an associated base unit said assembly may be mounted to a wall or the like and a cylindrical object may be lowered through a ring to rest on the support member therebelow to be held in position by the ring and associated support member generally against the concave front surface of the adjacent base unit.

4. The assembly of claim 3 wherein each base unit is spaced laterally from an adjacent base unit and is joined thereto by at least one laterally extending web member integral with facing side wall members of the adjacent base units.

5. The bracket assembly of claim 3 wherein each retainer ring has a cylindrical wall portion, an annular rib projecting outwardly of the wall portion at one end thereof, and a wedge member projecting radially of the wall portion for abutment against a wall or the like after said assembly has been mounted thereto.

6. A bracket assembly for supporting a plurality of cylindrical objects thereon comprising: a plurality of rearwardly open base units each including a longitudinally extending transversely concave front surface for cradling an object therein, a transversely convex rear surface, longitudinal side wall members extending rearwardly from said front surface, a cutout in each of said side wall members and a support member projecting forwardly from a lower portion thereof; a substantially inflexible annular retainer ring for each of said base units, each ring being adapted for retained engagement with the cutouts of an associated base unit and to project forwardly of the base unit front surface, each retainer ring having a cylindrical wall portion, an annular rib projecting outwardly of the wall portion at one end thereof, and a wedge member projecting radially of the wall portion for abutment against a wall or the like after said assembly has been mounted thereto; and means for securing said assembly to a wall or the like; whereby with each retainer ring engaging the cutouts of an associated base unit said assembly may be mounted to a wall or the like and a cylindrical object may be lowered through a ring to rest on the support member therebelow to be held in position by the ring and associated support member generally against the concave front surface of the adjacent base unit.

7. The assembly of claim 6 wherein each base unit is spaced laterally from an adjacent base unit and is joined thereto by at least one laterally extending web member integral with facing side wall members of the adjacent base units.

* * * * *